United States Patent [19]

Luedtke et al.

[11] Patent Number: 4,866,793

[45] Date of Patent: Sep. 19, 1989

[54] TOILET ANTI-SPLASH DEVICE

[76] Inventors: Richard C. Luedtke, Whiteladyes, Sandy Way, Cobham, Surrey KT11; Kandiah Mahanandan, Woden Cottage, Firs Road, Kenley, Surrey CR2, both of United Kingdom

[21] Appl. No.: 151,344

[22] Filed: Feb. 2, 1988

[51] Int. Cl.[4] ..... E03D 9/00

[52] U.S. Cl. ..... 4/300.3

[58] Field of Search ..... 4/300.3, 309, 416, 661, 4/452, 453, 457, DIG. 5, DIG. 18

[56] References Cited

U.S. PATENT DOCUMENTS

| | | | |
|---|---|---|---|
| 1,109,904 | 9/1914 | Dahlgren | 4/DIG. 5 |
| 2,011,732 | 8/1935 | Saeks | 4/309 |
| 2,508,808 | 5/1950 | Warman | 4/DIG. 5 |
| 2,679,054 | 5/1954 | Singleton | 4/DIG. 5 |
| 2,931,047 | 4/1960 | Stebbins | 4/300.3 |
| 2,984,841 | 5/1961 | Wilson | 4/309 |
| 3,540,433 | 11/1970 | Breckman | 4/661 |
| 3,614,790 | 10/1971 | Billingsly et al. | 4/300.3 |
| 3,723,998 | 4/1973 | Wehr | 4/300.3 |
| 4,215,443 | 8/1980 | Babik . | |
| 4,612,676 | 9/1986 | Whitman . | |

*Primary Examiner*—Philip R. Coe
*Assistant Examiner*—Joseph S. Machuga
*Attorney, Agent, or Firm*—Allan L. Harms

[57] ABSTRACT

A textured, contoured toilet anti-splash and silencer device for adjustable mounting on a toilet at the rear, or the front, of the bowl. The device, a contoured, textured maze, disperses urine into the water of the toilet bowl by breaking, without splash, the velocity of the urine stream, containing the urine within the contour, and then directionally draining the urine noiselessly into the water of the toilet. Depending solely upon the needs of the user the maze device can be suspended within the bowl on either adjustable mounts at the back of the toilet or on fixed mounts at the front of the toilet bowl, thereby ensuring that it is able to be positioned out of the way when the seat is lowered. The device is preferably made of molded plastics to ensure contours and for corrosion resistance. A flange on the device induces self-cleaning during toilet flushing in order to keep the device hygienically clean and odor free.

27 Claims, 2 Drawing Sheets

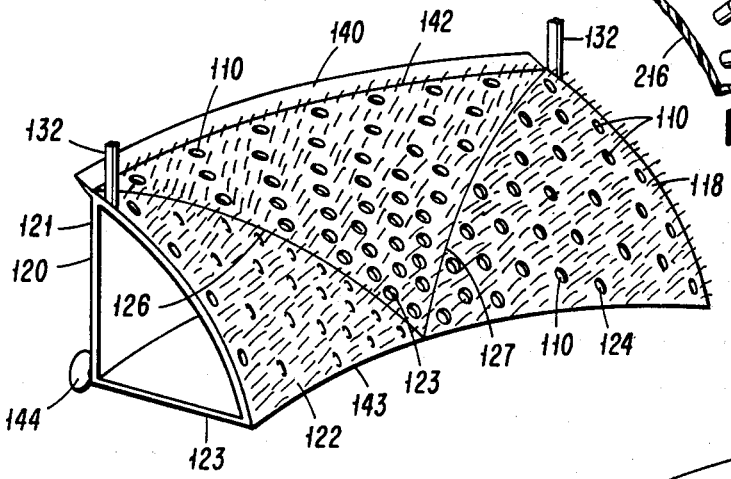
FIG 9
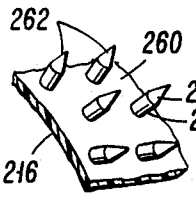
FIG 7
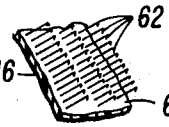
FIG 5
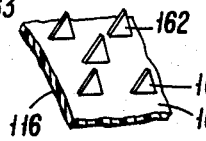
FIG 6
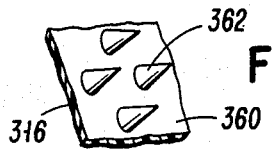
FIG 8
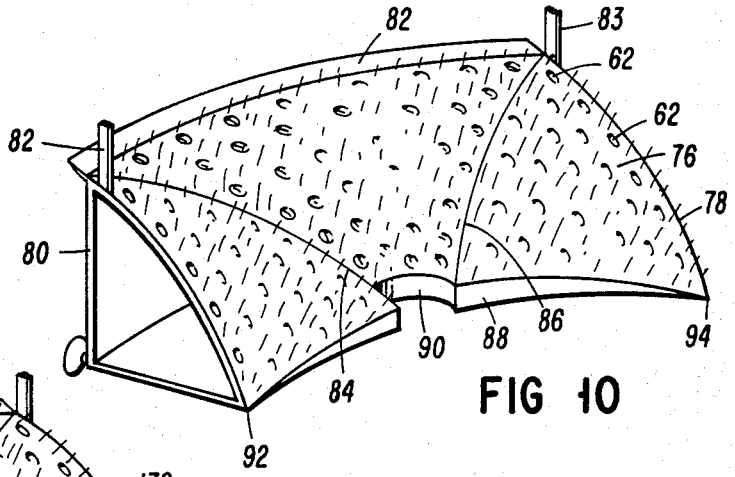
FIG 10
FIG 11
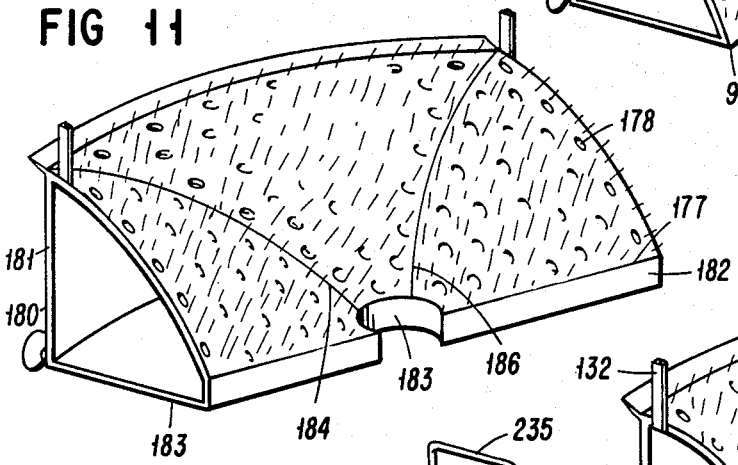
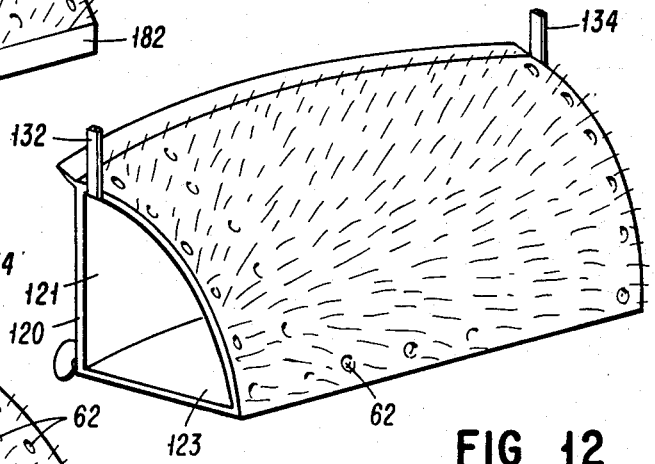
FIG 12
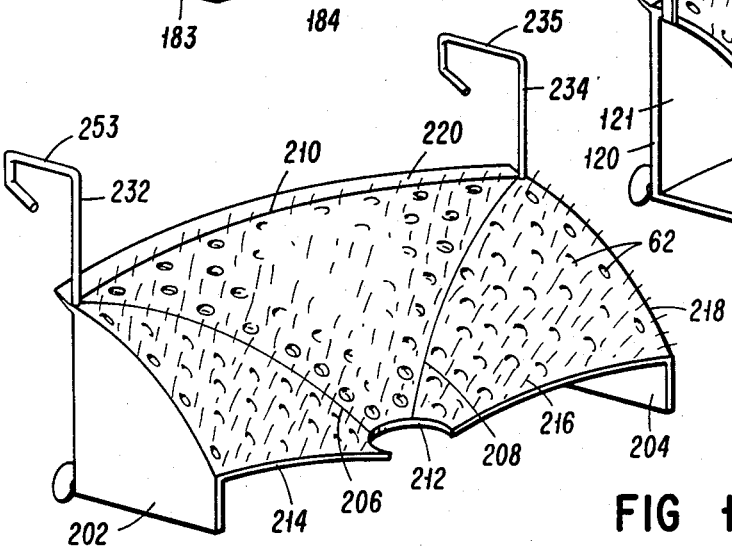
FIG 13

TOILET ANTI-SPLASH DEVICE

BACKGROUND OF THE INVENTION

This invention relates to toilet attachments and more particularly to anti-splash and noise abatement devices for toilet bowls.

The traditional toilet or water closet provides an open topped bowl containing a level of water therein, into which a urinating male may direct a stream of urine. The impact of the urine stream upon the surface of the water residing in the toilet bowl creates a splash, leading to noise and the sprinkling of the water-urine mixture onto the surrounding surfaces, including the toilet bowl rim and/or toilet seat, and surrounding floor. This circumstance leads to an unsanitary, unsightly and unsafe condition surrounding the toilet bowl.

Various devices have been developed to alleviate this troublesome problem. In U.S. Pat. No. 4,612,676, a urinal attachment fastens to the front of the toilet bowl and provides a receptacle into which a male child may direct his urinary output. This device is positioned above the toilet bowl and interferes with the use of the toilet by adult males and those desiring to lower the hinged seat and use the toilet in the seated position.

Another solution to the problem of splash noise and spray when a urine stream impacts water is presented in U.S. Pat. No. 4,215,443. A flat screen member is mounted to the toilet seat hinge to allow the screen to be presented near the back of the toilet bowl when the toilet seat is in the vertical, inoperable position. The screen member is intended to disperse the urine stream when it is directed onto the screen member. This device requires a hinge arrangement such that it can be positioned out of the way of the user when the toilet seat is down. Because of its employment of screening, some backsplash will occur and the dispersed urine will still make some splash noise as it drops from the screen member into the water in the toilet bowl. Additionally, the device of U.S. Pat. No. 4,215,443 requires considerable effort to retrofit it to an existing toilet and it can only be installed in the rear of the bowl.

SUMMARY OF THE INVENTION

The instant invention relates to antisplash devices for flush type toilets which can be easily retrofitted to existing installed toilets or installed on new toilet equipment. A contoured, textured maze is suspended by cabling from the hinge portion of the toilet seat assembly to enable the maze to rest against the toilet bowl inner sidewall. A flange is provided along an edge of the maze member to direct water delivered in flushing over and across the maze to clean it. Suction cup means are employed to maintain the maze element at rest abutting the inner toilet bowl sidewall. Once employed within the toilet bowl, no movement or displacement of the device is required in order to allow the toilet to be used in the seated position. Upward extending post elements depend from the maze to engage the under side of the toilet bowl lip. Various contours of the maze element may be employed to effect preferred results. In an alternative embodiment, formed members depend from the maze to overhang the edge of the toilet bowl, thereby allowing positioning of the invention at any position relative to the circumference of the toilet bowl. The surface of the maze is populated by impingement elements which slow the velocity of the incoming urine stream and retain the splash particles created by the urine impacting upon the maze.

One object of the invention is to provide a device to significantly reduce the splash which occurs when urine is directed into a toilet bowl containing a water level.

Another object of the invention is to provide an anti-splash device for flush toilets which reduces the noise created by the impact of a stream of urine directed into a toilet bowl.

Another object of the invention is to provide an anti-splash attachment for a toilet bowl which is easily retrofitted to the toilet bowl by the user.

Another object of the invention is to provide an anti-splash attachment for toilets which can be used with all types of existing toilet bowls.

Another object of the invention is to provide an anti-splash attachment for a toilet which self-cleans when the toilet is flushed.

Another object of the invention is to provide an anti-splash attachment for a toilet bowl which provides improved delivery of urine into the water within the toilet.

These and other objects of the invention will be apparent from the detailed description which follows.

DESCRIPTION OF THE DRAWINGS

FIG. 5 is an enlarged view of a segment of the surface of the preferred embodiment of the invention.

FIG. 6 is an enlarged view of a segment of the surface of an alternative embodiment of the invention.

FIG. 7 is an enlarged view of a segment of the surface of another alternative embodiment of the invention.

FIG. 8 is a enlarged view of a segment of the surface of another alternative embodiment of the invention.

FIG. 9 is a view in perspective of an alternative embodiment of the invention.

FIG. 10 is a view in perspective of another alternative embodiment of the invention.

FIG. 11 is a view in perspective of another alternative embodiment of the invention.

FIG. 12 is a view in perspective of another alternative embodiment of the invention.

FIG. 13 is a view in perspective of another alternative embodiment of the invention.

DETAILED DESCRIPTION OF THE INVENTION

Figure 1:
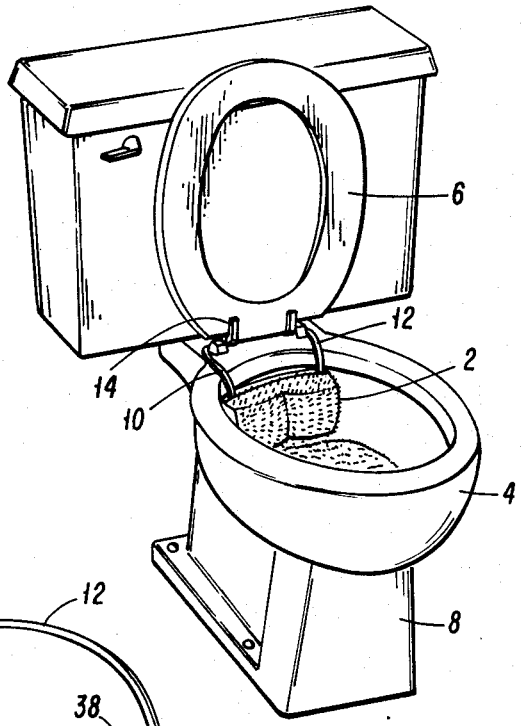
FIG. 1 is a front left perspective view of the invention installed upon a typical toilet.

Referring to the drawing figures, and in particular to FIG. 1, invention 2 may be seen installed within the toilet bowl 4 of typically configured general purpose toilet 8. In FIG. 1, the toilet's seat 6 is shown in the stored position merely for clarity of illustration. The placement of the seat 6 in position for use of the toilet in the seated position does not require removal or adjustment of invention 2. Cable segments 10 and 12 extend from invention 2 about hinge 14 of toilet 8.

Figure 2:
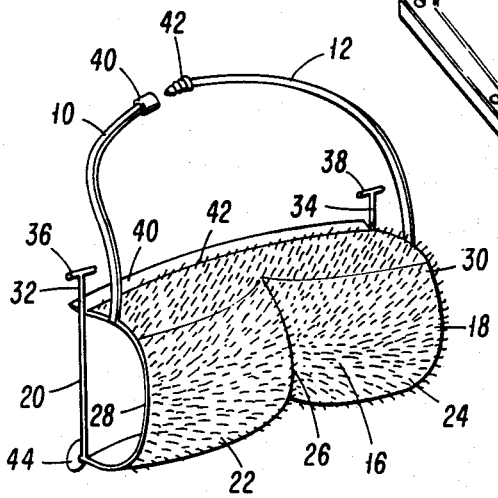
FIG. 2 is a perspective view of the preferred embodiment of the invention.

The invention 2 is better visualized in FIG. 2 where the textured, contoured surface 16 of maze or front wall 18 is shown. Maze 18 protrudes from frame 20 in contoured fashion. In the preferred embodiment, maze 18 comprises lobes 22 and 24, which are joined at juncture 26. Each of lobes 22 and 24 is curved from juncture 26 to the opposing edges 28 and 30 respectively. Posts 32 and 34 depend from frame 20 and terminate with transverse elements 36 and 38. Cable segments 10 and 12 depend from maze 18 and are selectively joinable by interlocking connectors 40 and 42. In practice, Teflon or other synthetic cable material may be used which is similar to that used to secure bundles of parallel wires. Such cable tie fasteners form an endless loop when the trapping connectors are interlocked. In the preferred embodiment, segments of cable are to be utilized though a loop of cable could be passed between the frame 20 and maze 18 and selectively joined at the interlocking connectors 40 and 42 in the installation of the device to the toilet.

Flange 40 is constructed of surface conformable, non-porous material and is mounted at the upper edge 42 of maze 18. Flange 40 may comprise synthetic rubber or like material, in practice. Flange 40 is appropriately curved to coincide with the contour of upper edge 42 of maze 18. Suction cup 44 depends rearward from the intersection of frame 20 and maze 18. Similarly, a second suction cup is provided in a symmetrical location on the invention, though the second suction cup cannot be seen in FIG. 2.

Figure 3:
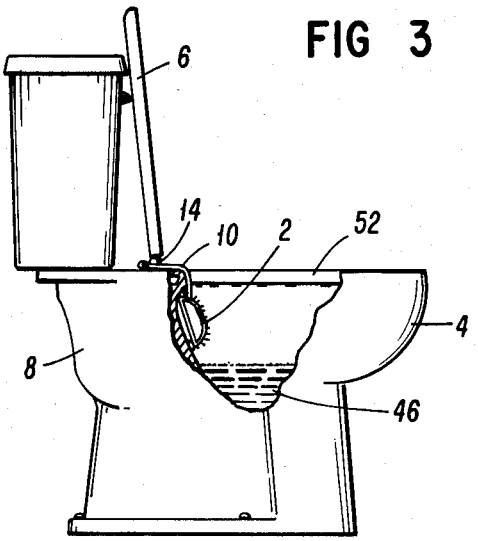
FIG. 3 is a side elevation of a typical toilet with part of the toilet bowl cut-away showing the invention installed upon the toilet.
Figure 4:
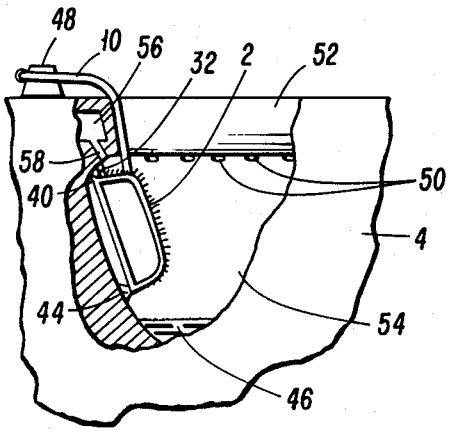
FIG. 4 is an enlarged view in section of the cut-away portion of FIG. 3.

Referring to FIGS. 3 and 4, the detail of installation of the invention upon toilet 8 can be seen. Invention 2 is suspended within toilet bowl 4 above water 46 which is shown at the quiescent level experienced when no flushing action is under way. Cable segment 10 passes about mount 48 to which toilet seat hinge 14 is mounted and is fastened to maze 18. Seat 6 may be raised or lowered without interference from or effect on invention 2. Inlet openings 50, a plurality of which are spaced about and under rim 52 of toilet bowl 4, are well known in flush toilet art to provide a supply of fresh water to the inner sidewall 54 of the toilet bowl 4. Passageway 56 within rim 52 provides the supply of fresh water to tube 58 which supplies openings 50.

Flange 40 of invention 2 collects water directed onto sidewall 54 during flushing and directs such water over maze 18 thereby rinsing surface 16 of maze 18. Suction cup 44 engages sidewall 54 to resist movement of invention 2 relative to sidewall 54. Posts 32 engage the underside of rim 52 to promote stability of placement of invention 2.

FIG. 5 depicts a small area of the surface 16 of maze 18 of the preferred embodiment. Surface 16 is populated by tiny impingement elements 62 which depend from the face 60 of surface 16. Impingement elements 62 provide a non-reflective texture for surface 16. In the preferred embodiment the impingement elements 62 approximate tiny hooks depending from face 60 in a substantially non-parallel relationship to face 60. The connecting fabric known commercially as Velcro TM may be used to provide suitable material for the surface 16 of maze 18.

FIG. 6 discloses an alternative form of impingement elements for an alternative embodiment of the invention. Substantially triangular plates 162 depend from face 160 of surface 116 of this alternative embodiment of the invention.

FIG. 7 discloses another form of impingement elements for an alternative embodiment of the invention. Spear elements 262 depend from face 260 of surface 216 of this alternative embodiment of the invention. Each spear element 262 comprises a column 263 supporting a cone 265.

FIG. 8 discloses yet another form of impingement elements of an alternative embodiment of the invention. Cone elements 362 depend from face 360 of surface 316 of this embodiment of the invention.

Alternative embodiments of the maze element of the invention are taught in FIGS. 9 through 13. In FIG. 9, maze 118 is trifurcated into lobes 122, 123, and 124. Channels 126 and 127 are formed by the junction of lobes 122 and 123 and lobes 123 and 124 respectively. Flange 140 follows and is fixed to the contour of maze 118 at its upper boundary 142. Frame 120 engages maze 118 at its upper boundary 142 and at its lower boundary 143. Cable segments 132 and 134, shown partly cut-away, depend from the ends of maze 118 at the upper boundary of maze 118. Suction cup 144 is fixed to frame 120 at the intersection of first wall 121 and second wall 123. Openings 110 are spaced throughout surface 116 of maze 118.

Referring now to FIG. 10, another embodiment of the maze element of the invention is shown. Impingement elements 62 populate surface 76 of maze body 78. Maze body 78 is supported by frame 80. Cables 82 and 83 are shown partly cut-away, depending from maze body 78. Flange 82 depends from upper edge of maze body 78 and is co-curvilinear therewith. Valleys 84 and 86 are formed upon maze body 78 and intersect front wall 88 of maze body 78. A curved recess 90 in front wall 88 is centrally located therealong. Front wall 88 tapers to a line as it approaches the corners 92 and 94 of maze body 78.

It may be noted that the maze element or body may also be employed to reduce splash back in standing urinals, as well as in flush toilets. The maze body 78 and frame 80 may be placed in the rear lower area of a standing urinal such that urine directed into the urinal may engage surface 76 of maze body 78. Impingement elements 62 will break up and slow down the stream of urine striking surface 76. Curved recess 90 may surround the drain of the urinal. Valleys 84 and 86 collect urine impinging on surface 76 and direct it into curved recess 90 of front wall 88.

In FIG. 11, another embodiment of the maze element of the invention is shown. Frame 180 is provided with a vertical wall 181, a generally horizontal wall 183 and an upwardly extending lip 182 to which is mounted the lower edge 177 of maze body 178. A generally cylindrical recess 183 is provided within the lip 182 to which valleys 184 and 186 join.

In FIG. 12, another embodiment of the maze element of the invention is disclosed. Continuously curved surface 216 is populated by impingement elements 62 and is supported by frame 120. Frame 120 comprises vertical sidewall 121 and horizontal sidewall 123. Surface 216 is convex relative to sidewalls 121 and 123 of frame 120 and is supported thereby. Surface 216 is constructed of moldable materials of moderate stiffness which will maintain the contours intended for surface 216. Cables 132 and 134 are shown partly cut away. Openings 110 are provided within surface 216.

FIG. 13 discloses yet another embodiment of the invention. Maze 218 is a molded sheet of material having impingement elements 62 depending therefrom, thereby creating a textured surface 216. Hanger members 232 and 234 extend from the sides of maze 218 with the free ends of each hanger member terminated in hooks 233 and 235 respectively. Maze 218 is molded to include vertically depending sidewalls 202 and 204 emanating from the edges of surface 216. Elongated depressions 206 and 208 pass across surface 216 from the upper edge 210 thereof to indentation 212 at lower edge 214. Resilient flange 220 follows the convexity of upper edge 210 of maze 218 and is attached therealong. When in use, hangers 232 and 234 embrace the rim of the toilet bowl and allow the embodiment of FIG. 13 to be suspended in the toilet bowl at any circumferential position.

OPERATION OF THE INVENTION

The invention is placed within the toilet bowl and suspended by cabling from the toilet seat hinge or by hangers from the toilet bowl rim. The invention is suspended above the water level and provides an impingement body upon which a stream of urine may be directed. In striking the textured surface of the invention, the urine stream is dispersed and trapped by the impingement elements depending from the surface. In the preferred embodiment, the urine collected upon the textured surface of the invention is allowed to drain over the surface and fall quietly into the water within the toilet bowl. When flushing of the toilet occurs, the flange mounted to the top rear of the device collects fresh water directed down the inner sidewall of the toilet bowl and directs it to cascade over the textured surface of the invention, thereby flushing the surface of the invention.

In an alternative embodiment of the invention, openings allow urine to pass through the textured maze so that it may drop from the rear, as well as the front of the surface of the invention. Alternative impingement element designs provide other dispersal elements for capturing and slowing the velocity and rebound of urine droplets striking the invention. Valleys molded in the surface also serve to collect and provide controlled drainage of the impinging urine from the textured surface of the device.

Because of its simplified design, invention 2 may be installed on existing toilets by the end user, without special tools.

Having thus described the invention, I claim:

1. Apparatus for eliminating splash of urine entering a toilet bowl, said toilet bowl equipped with a rim and having a hinged seat mounted thereto, the invention comprising a body having a non-planar front wall said front wall having a population of impingement elements depending therefrom and forming a textured surface.

at least one hanger member depending from said body, said hanger member non-pivotally mounting said body in stationery engagement with and against the inner surface of said toilet bowl above the ambient water level therein and below said rim.

2. The invention of claim 1 wherein said impingement elements depend generally perpendicularly from said front wall.

3. The invention of claim 1 wherein said impingement elements are substantially small relative to said front wall.

4. The invention of claim 1 wherein said impingement elements are tiny hooks.

5. The invention of claim 1 wherein said impingement elements are tiny cylinders.

6. The invention of claim 1 wherein said impingement elements are tiny pyramids.

7. The invention of claim 1 wherein said impingement elements are tiny polygons, each of said polygons comprises a cone atop a cylinder.

8. The invention of claim 1 wherein said front wall is provided with a plurality of contours thereupon, said contours of said front wall are sloped toward the center of said front wall.

9. The invention of claim 1 wherein said at least one hanger element comprises a pair of interconnectable cables mounted to said body, said cables are selectively connectable about said hinge of said toilet seat.

10. The invention of claim 1 wherein said front wall is provided with a generally flexible flange depending from the top thereof, said flange engages the inner surface of said toilet bowl whereby said flange collects water delivered to the inner surface of said bowl when flushing of said toilet occurs, said flange directs said water onto the surface of said front wall.

11. The invention of claim 10 wherein said front wall is provided with an upper edge along the top thereof, said flange generally coextends said upper edge of said front wall.

12. The invention of claim 1 wherein said at least one hanger member overhangs said rim of said toilet bowl.

13. The invention of claim 1 wherein said at least one hanger element comprises a pair of formed elongated bars mounted to said body, said pair of formed elongated bars overhang said rim of said toilet bowl.

14. The invention of claim 1 wherein said body is provided with vertically depending posts, said posts are mounted to said body at the ends thereof, said posts engage the underside of said rim of said toilet bowl.

15. The invention of claim 1 wherein said body is provided with suction cups at the rear thereof, said suction cups engage said toilet bowl at the inner surface thereof.

16. Antisplash apparatus for placement in urine receiving apparatus to receive a stream of urine, the invention comprising a body having a contour front wall, said front wall having, a population of impingement elements depending therefrom and forming a textured surface, said body being stationary within said urine receiving apparatus, said front wall has a plurality of openings, and is separated into lobes by an elongated depression.

17. The invention of claim 16 wherein said front wall is convex.

18. Antisplash apparatus for placement in urine receiving apparatus to receive a stream of urine, the invention comprising a body having a contoured front wall, said front wall having, a population of impingement elements depending therefrom and forming a textured surface, said front wall has an upper and a lower edge, said front wall has a plurality of elongated depressions thereupon, said elongated depressions converge at said lower edge thereof, said front wall has openings therein.

19. The invention of claim 18 wherein said upper edge of said front wall has a rearwardly depending flange mounted thereto, said body is provided with suction cups mounted thereon to engage said urine receiving apparatus.

20. The invention of claim 18 wherein said impingement elements are tiny hooks.

21. The invention of claim 18 wherein said impingement elements are tiny loops.

22. Apparatus for eliminating splash of urine entering a toilet bowl, said toilet bowl equipped with a rim and having a hinged seat mounted thereto, the invention comprising a body having a textured convex front wall disposed within said toilet bowl, at least one hanger member depending from said body, said hanger member suspending said body adjacent the inner surface of said toilet bowl above the ambient water level therein, said texture of said front wall comprises impingement elements provided thereupon, said impingement elements depend generally perpendicularly from said front wall said front wall is provided with at least one elongated depression said at least one elongated depression separates said front wall into contoured lobes.

23. The invention of claim 22 wherein said impingement elements are substantially small relative to said front wall.

24. The invention of claim 22 wherein said body is stationary when installed in said toilet bowl.

25. The invention of claim 22 wherein said front wall has a plurality of openings therein.

26. The invention of claim 22 wherein said body is disposed beneath said toilet seat when said toilet seat is in its lowered position.

27. The invention of claim 22 wherein said impingement elements are tiny polygons.

* * * * *